US006772911B2

(12) United States Patent
Gee et al.

(10) Patent No.: US 6,772,911 B2
(45) Date of Patent: Aug. 10, 2004

(54) FLOW CONTROLLER FOR CONTAINER

(76) Inventors: Kevin Gee, 10993 Stoney Point Dr., South Lyon, MI (US) 48178; John M. Naber, 4405 Shady Hill, Lansing, MI (US) 48917

( * ) Notice: Subject to any disclaimer, the term of this patent is extended or adjusted under 35 U.S.C. 154(b) by 162 days.

(21) Appl. No.: 10/271,262

(22) Filed: Oct. 15, 2002

(65) Prior Publication Data

US 2004/0069799 A1 Apr. 15, 2004

(51) Int. Cl.[7] ..... B67D 5/00

(52) U.S. Cl. ..... 222/83; 222/85; 222/91; 222/153.14; 222/481.5

(58) Field of Search ..... 222/81, 83, 85, 222/91, 153.06, 153.14, 481.5

(56) References Cited

U.S. PATENT DOCUMENTS

| | | | | | |
|---|---|---|---|---|---|
| 1,941,929 | A | | 1/1934 | Burdick | 221/28 |
| 3,236,697 | A | * | 2/1966 | Amiet et al. | 429/116 |
| 3,995,773 | A | * | 12/1976 | Schmit | 222/91 |
| 4,266,693 | A | | 5/1981 | Pfeiffer | 222/135 |
| 4,307,821 | A | * | 12/1981 | McIntosh | 222/83 |
| 4,351,455 | A | | 9/1982 | Bond | 222/153 |
| 4,624,392 | A | * | 11/1986 | Malpas et al. | 222/83 |
| 4,798,605 | A | * | 1/1989 | Steiner et al. | 604/411 |
| 4,949,878 | A | | 8/1990 | Jacobi | 222/382 |
| 4,991,634 | A | * | 2/1991 | Tudek | 141/330 |
| 4,993,604 | A | * | 2/1991 | Gaunt et al. | 222/481.5 |
| 5,072,762 | A | * | 12/1991 | Jimenez | 141/329 |
| 5,121,845 | A | | 6/1992 | Blanchard | 215/232 |
| 5,123,570 | A | * | 6/1992 | Dubow et al. | 222/83 |
| 5,356,042 | A | | 10/1994 | Huffman et al. | 222/153 |
| 5,358,136 | A | | 10/1994 | Rubendall | 220/346 |
| 5,379,918 | A | | 1/1995 | Goto | 222/82 |
| 5,915,578 | A | | 6/1999 | Burt | 215/250 |
| 6,050,451 | A | | 4/2000 | Hess, III et al. | 222/92 |
| 6,269,981 | B1 | | 8/2001 | Nielsen | 222/385 |
| 6,401,982 | B1 | | 6/2002 | Grittmann | 222/153.05 |
| 6,460,732 | B1 | * | 10/2002 | Drennow | 222/83 |
| 6,609,634 | B2 | * | 8/2003 | De Laforcade et al. | 222/1 |
| 6,626,309 | B1 | * | 9/2003 | Jansen et al. | 215/249 |

* cited by examiner

*Primary Examiner*—Joseph A. Kaufman
(74) *Attorney, Agent, or Firm*—John M. Naber

(57) ABSTRACT

A flow controller for a container including a slide member guide, having a first peripheral flange on an outer surface, and configured to be either integral with the container or to be attached separately to a neck of the container. The neck includes a seal. A slide member is slideably and rotatably carried within the slide member guide. The slide member includes a second peripheral flange attached to an outer surface of the slide member to provide a space for insertion of a shipping pin between the first and second peripheral flanges. The shipping pin prevents an inner edge of the slide member from contacting and puncturing the seal. The container can include a lancing pin disposed on the inside of the container and is configured to contact the slide member at a top end and actuate an air vent at the opposite end.

19 Claims, 9 Drawing Sheets

FLOW CONTROLLER FOR CONTAINER

FIELD OF THE INVENTION

The present invention relates generally to the field of fluid containers and dispensers, and in particular to a flow controller for a container suitable for motor oils and the like.

BACKGROUND OF THE INVENTION

During the course of periodic maintenance of most motor vehicles, virtually all vehicle operators find themselves required to add motor oil from time to time. Most motor oils for consumer use are now packaged and sold in quart size molded plastic containers having extended neck portions and corresponding molded plastic caps. The caps are typically removable by a threaded mount. While the advent and proliferation of such molded plastic containers has, to some extent, reduced the mess associated with the addition of oil to the vehicle, it often remains a messy and inconvenient task. See generally, U.S. Pat. No. 5,121,845 to Blanchard.

Most motor vehicle engine configurations do little to improve the ease of adding motor oil by the consumer. Many engines are designed to require adding oil through apertures that are near the center of the engine and therefore at an extended distance from the vehicle perimeter. This frequently leads to some oil spillage as the container is inverted to dispense the oil. In the past, vehicle operators have attempted to address these problems by using a variety of devices such as funnels. Unfortunately, the use and storage of such devices is often as messy as the direct introduction of motor oil without their use.

Thus there is a need and a desire to provide a fluid dispensing system that can be inverted and control fluid flow in a manner to eliminate or minimize spilling while maximizing flow once the dispenser is in place. In the case of motor oil, such a device would need to avoid spilling oil onto the vehicle engine or associated components within the restricted access of the typical engine compartment.

Attempts to meet this need are known in the art. Some provide various types of extendable spouts on the oil container or spout extensions, which are provided as an "add-on" or premium item. Other attempts add messy, expensive, complicated, or impractical devices to oil containers and other types of fluid containers. See generally, U.S. Pat. No. 5,915,578 to Burt; U.S. Pat. No. 5,356,042 to Huffman et al.; U.S. Pat. No. 5,358,136 to Rubendall; U.S. Pat. No. 6,050,451 to Hess, III et al.; and U.S. Pat. No. 1,941,929 to Burdick. These attempts have, to date, met with very limited success and a solution remains evasive. The problem is further exacerbated by the extreme economic pressure upon the manufacturers of motor oil products. Oil and its processing are expensive and because competition in the marketplace is extremely price sensitive, motor oil manufacturers must seek to minimize the costs associated with bottling and packaging their oil products.

Thus, very little additional money is available within the product price to justify complex or expensive bottling concepts for the sake of user convenience. As a result, there remains a need in the art for a low cost and effective container for facilitating the ease and cleanliness of adding motor oil to the typical motor vehicle.

SUMMARY OF THE INVENTION

Accordingly, one embodiment of the present invention provides a flow controller for a container suitable for dispensing motor oils and the like. More specifically, the present invention facilitates the easy and clean addition of oil to a typical motor vehicle.

In accordance with the present invention, there is provided for use in combination with a fluid container having a seal, a flow controller including a shipping pin, and a cylindrical slide member guide attached to a neck of the container. The slide member guide includes a first peripheral flange attached to an outer surface of the slide member guide and a slide member is slidably and rotatably carried within the slide member guide. The slide member includes an outer end that is configured to receive a removable cap and includes a second peripheral flange on an outer surface of the slide member. The second peripheral flange is positioned to provide an annular space for insertion of the shipping pin between the first and second peripheral flanges and to prevent the inner edge of the slide member from contacting the seal.

In another embodiment, the present invention includes a device for controlling the flow of fluid from a container, including a shipping pin and a container having an interior reservoir, a neck and a slide member guide. The neck includes a seal and the slide member guide includes a first peripheral flange on an outer surface of the slide member guide. A slide member has an inner end, and an outer end is slidably received within the slide member and the inner end has an open inner edge. The slide member includes an outer end that receives a removable cap and a second peripheral flange on an outer surface of the slide member. The first and second peripheral flanges are positioned to provide an annular space for insertion of the shipping pin between the first and second peripheral flanges and to prevent the inner edge of the slide member from contacting the seal.

Other features and advantages of the present invention will become more apparent to persons having ordinary skill in the art to which the present invention pertains from the following description taken in conjunction with the accompanying figures.

BRIEF DESCRIPTION OF THE FIGURES

The foregoing advantages-and features, as well as other advantages and features, will become apparent with reference to the description and figures below, in which like numerals represent like elements and in which.

DETAILED DESCRIPTION OF THE INVENTION

The present invention generally involves the field of fluid dispensers, and in particular a flow controller suitable for use with motor oil containers and the like that economically simplify and enhance adding motor oils to motor vehicles.

Figure 1:
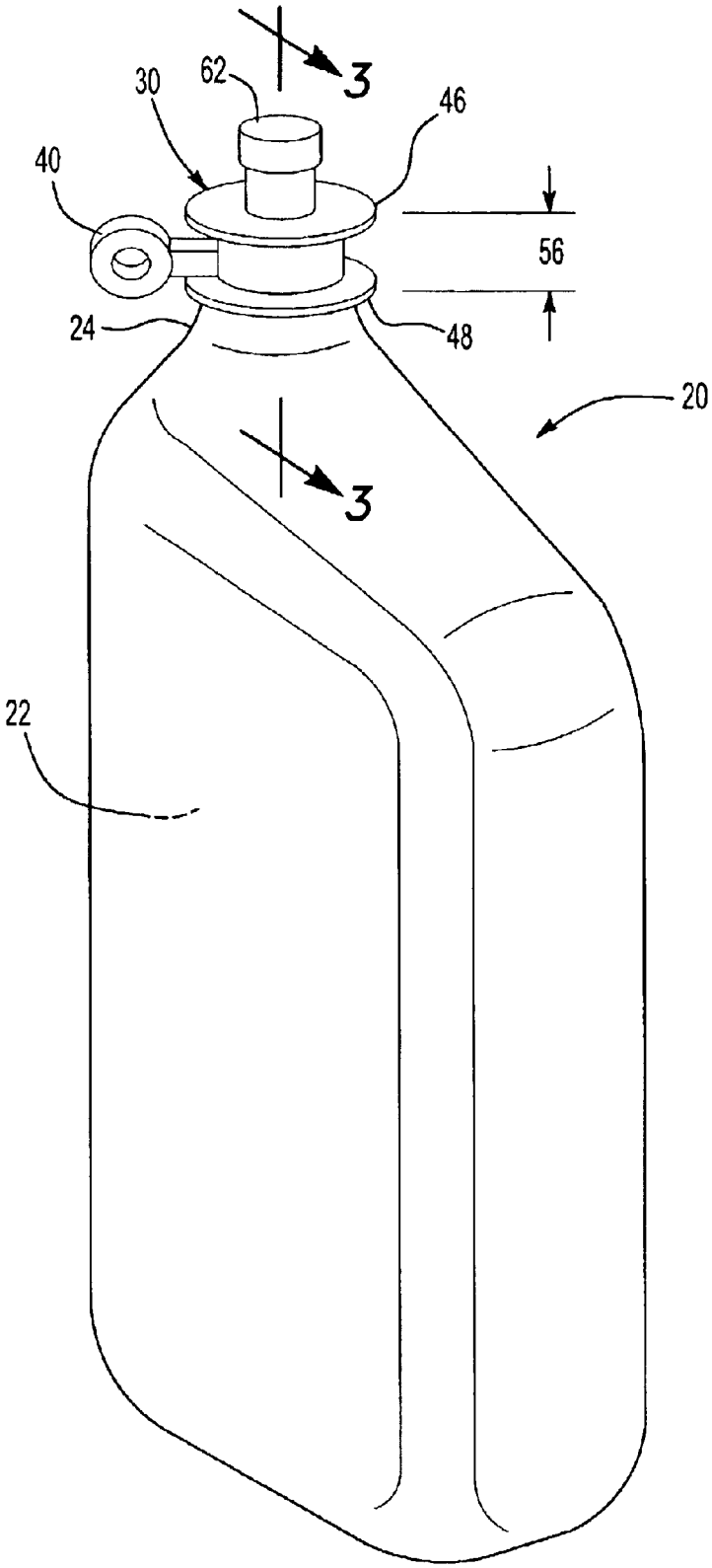
FIG. 1 is a perspective view of one embodiment of the flow controller for a container of the present invention in a closed or stored position.

FIG. 1 illustrates a perspective view of one embodiment of a flow controller 30 of the present invention on a container generally indicated at 20 in a closed position. This position would be used for storage and shipping to prevent accidental release of the contents.

Figure 2:
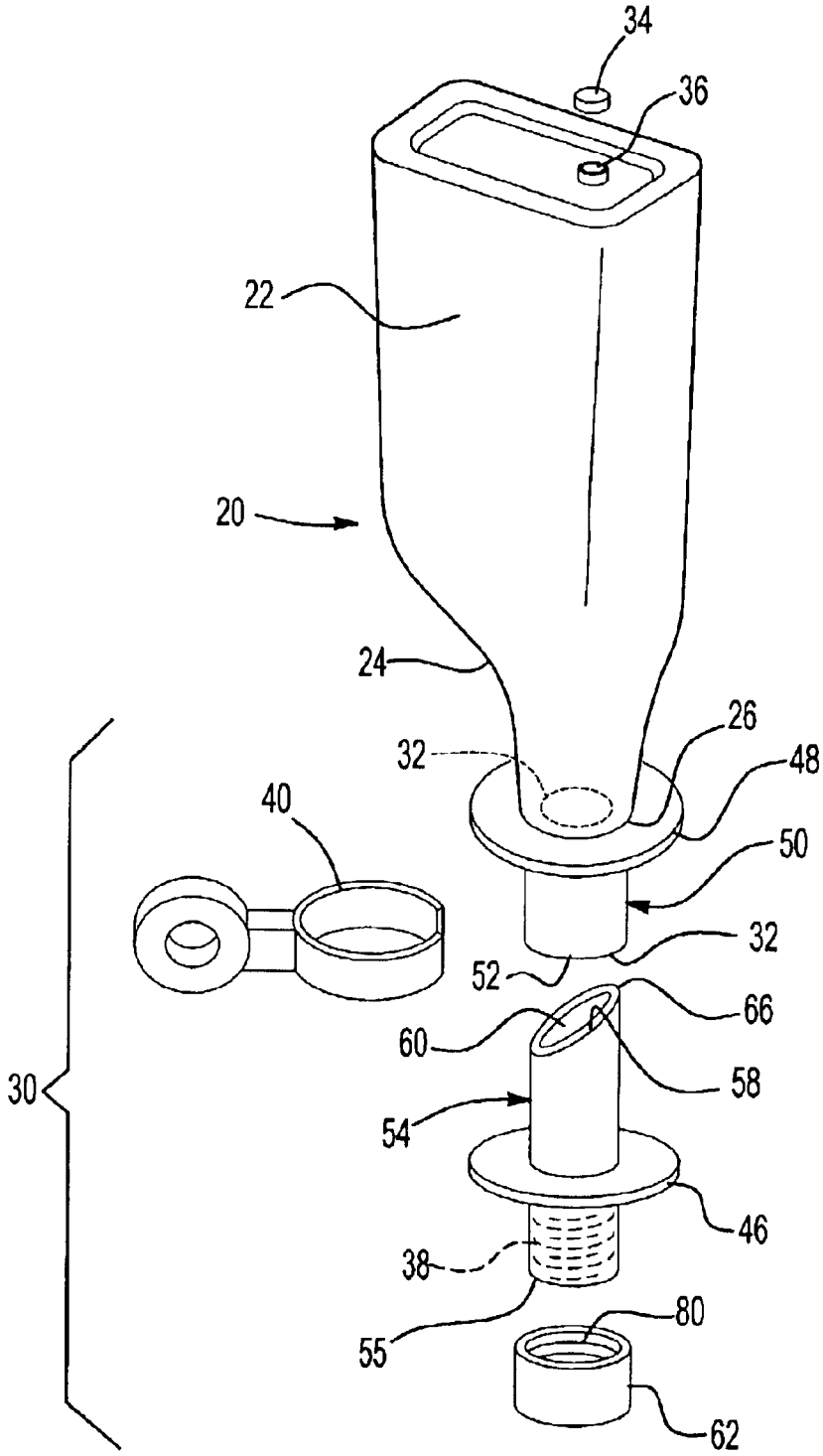
FIG. 2 is an exploded perspective view of one embodiment of the flow controller for a container of the present invention in an inverted orientation.
Figure 3:
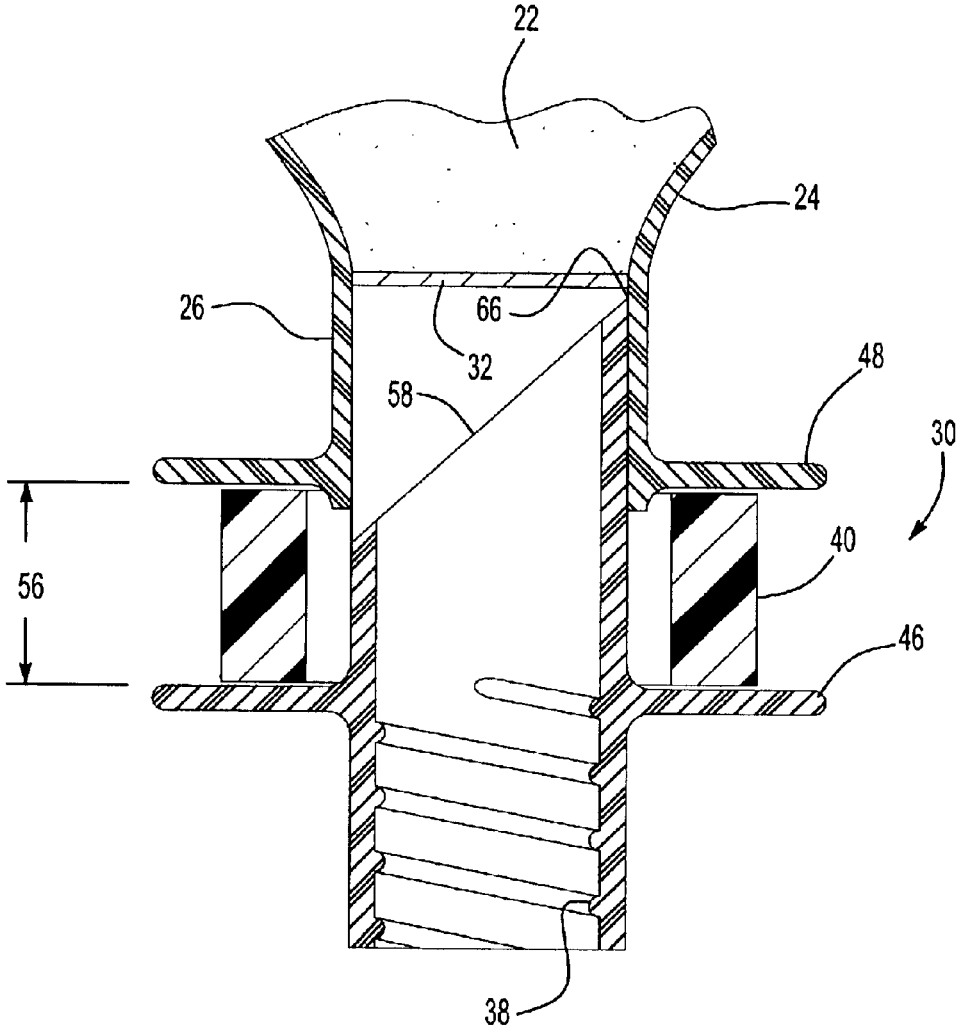
FIG. 3 is a sectional view cut along line 3—3 in FIG. 1 in an inverted orientation and illustrating a closed or stored condition.

To illustrate application of the present invention, container 20 can be a conventional oil container or other type of container formed in a typical molded plastic bottle including an interior fluid reservoir 22 and an upwardly extending generally cylindrical neck 24. Neck 24 in further accordance with conventional fabrication techniques defines a generally flat annular upper edge 26 (FIG. 2). A generally disk-shaped seal 32 is received by neck upper edge 26 and is attached thereto by conventional means such as an adhesive or the like. The seal can be a flexible material or other type of puncturable material such as plastic, rubber, paper or other like material. As shown in this embodiment, seal 32 is shown within the neck 24 region of container 20, while in FIGS. 5, 6, and 7 the seal 32 is placed on top of the neck upper edge 26.

Container 20 can also be modified in one embodiment, as illustrated in FIG. 2, to include an air vent on the bottom of container 20 by including a vent cap 34 attached by various means known in the art (such as internal threads) to a container bottom opening 36 having external threads.

Figure 5:
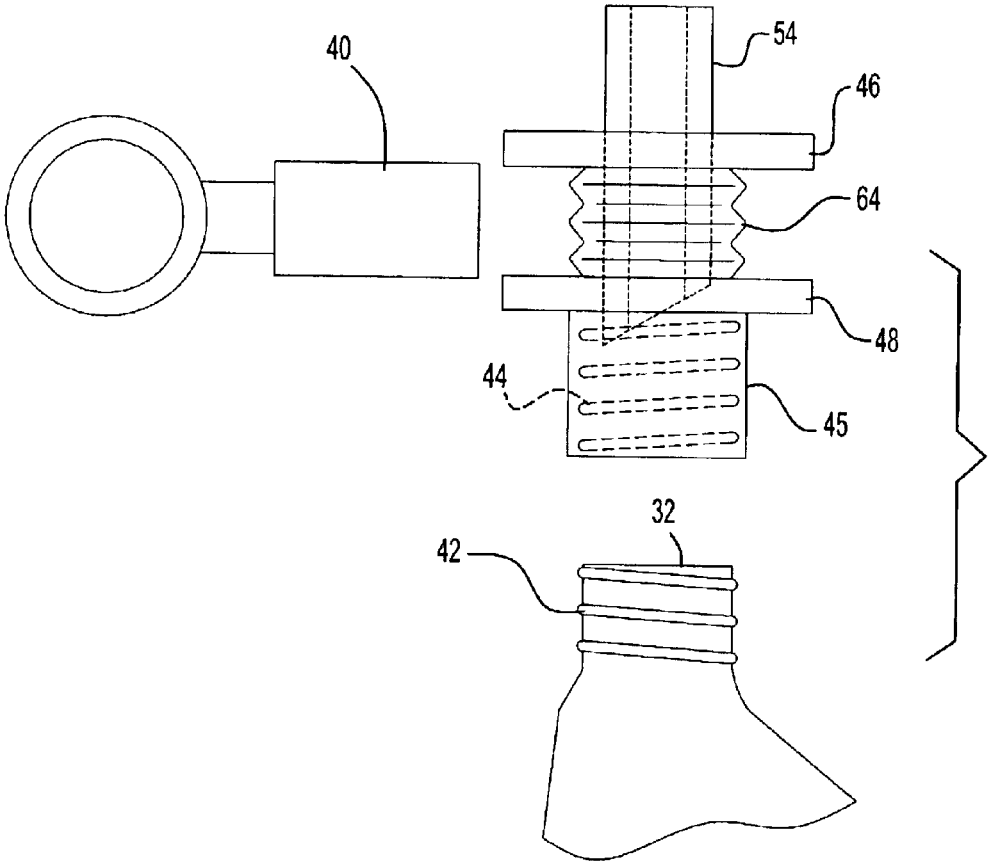
FIG. 5 is a side view of an alternate detachable embodiment of the flow controller for a container of the present invention.
Figure 6:
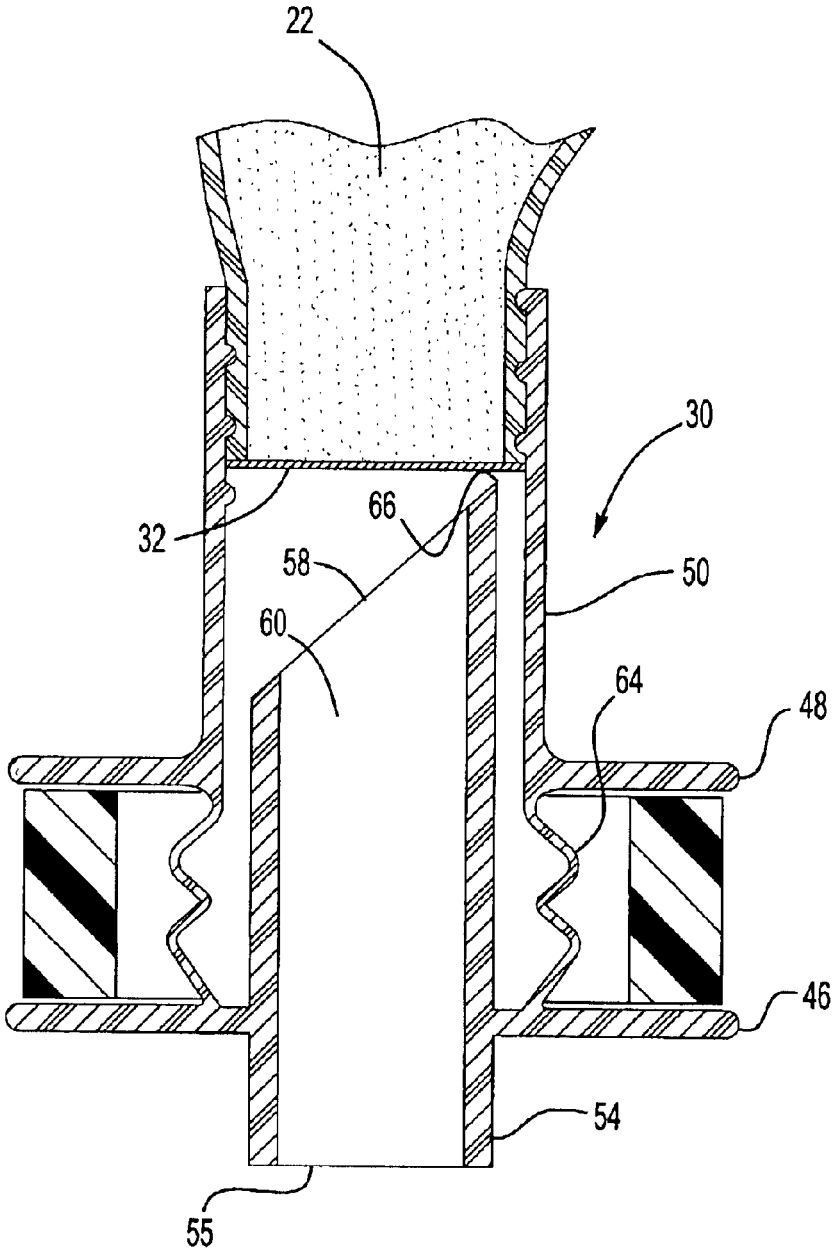
FIG. 6 is a sectional view cut along line 3—3 in FIG. 1 illustrating an alternate detachable embodiment of the flow controller in an inverted and closed or stored condition.

The flow controller 30 of the present invention generally allows a user to invert a sealed container and puncture the seal of the inverted container when the user desires to empty its contents in a clean, fast, and controlled manner. Flow controller 30 of the present invention can be configured to be integral with the container 20 or any similar type of container as shown in FIGS. 1, 2, 3, and 4; or in an alternate embodiment, as a detachable unit as shown in FIGS. 5, 6, and 7.

As illustrated in FIGS. 1, 2, 3 and 4, the flow controller 30 has a first peripheral flange 48 on a slide member guide 50 (or as part of neck 24 of container 20) and a second peripheral flange 46 on a slide member 54. First peripheral flange 48 is concentrically attached to an outside surface of slide member guide 50 and can take on any variety of shapes to allow grasping by a user. In this illustration, slide member 54 is an annular tubular slide, though other types are possible. In this illustration, slide member guide 50, is carried integrally by neck portion 24 and is disposed concentrically thereof, and has a cylindrical socket or hollow passage 52 extended beyond seal 32 for slideably and rotatably receiving the slide member 54. In alternate embodiments, slide member guide 50 need only conform to the shape of slide member 54.

Second peripheral flange 46 is spaced on slide member 54 axially and outwardly from seal 32 to provide a sufficient annular space 56 for insertion of a shipping pin 40 between the peripheral flanges 46 and 48 and to hold an open inner edge 58 of slide member 54 off seal 32, thus keeping seal 32 in tact. Inner edge 58 is configured to pierce seal 32 when it is urged against seal 32 by the user. In the illustrated embodiment, inner edge 58 is formed at an angle to provide a piercing point 66.

Figure 4:
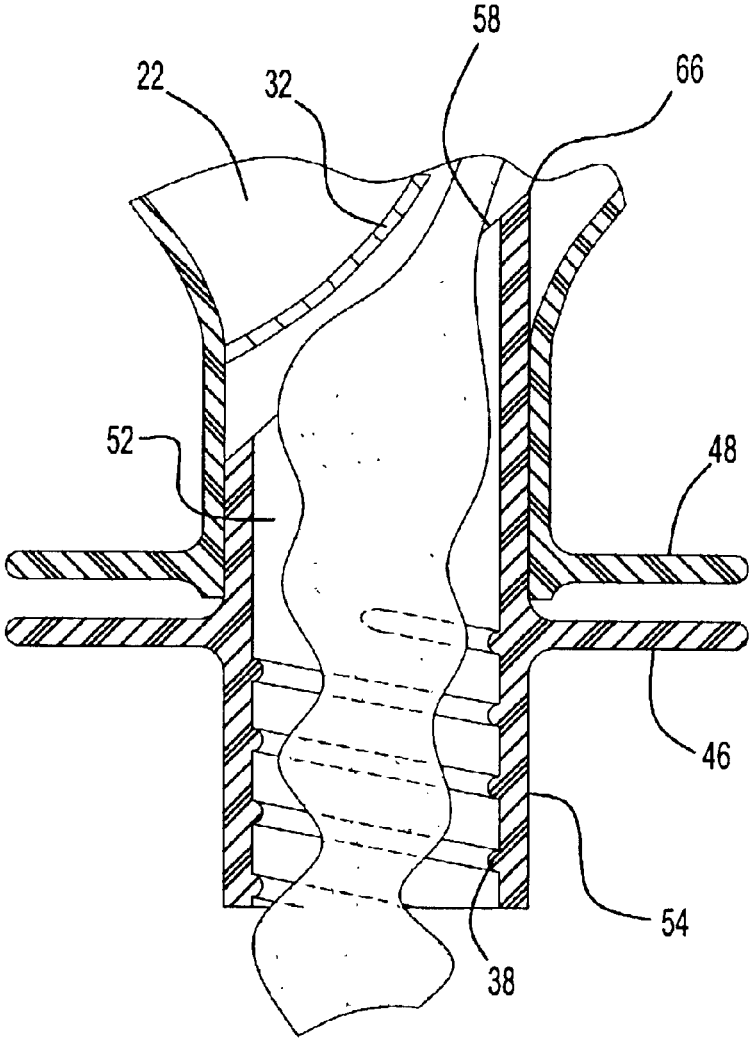
FIG. 4 is a sectional view cut along line 3—3 in FIG. 1 in an inverted orientation and illustrating an opened or in-use condition.
Figure 7:
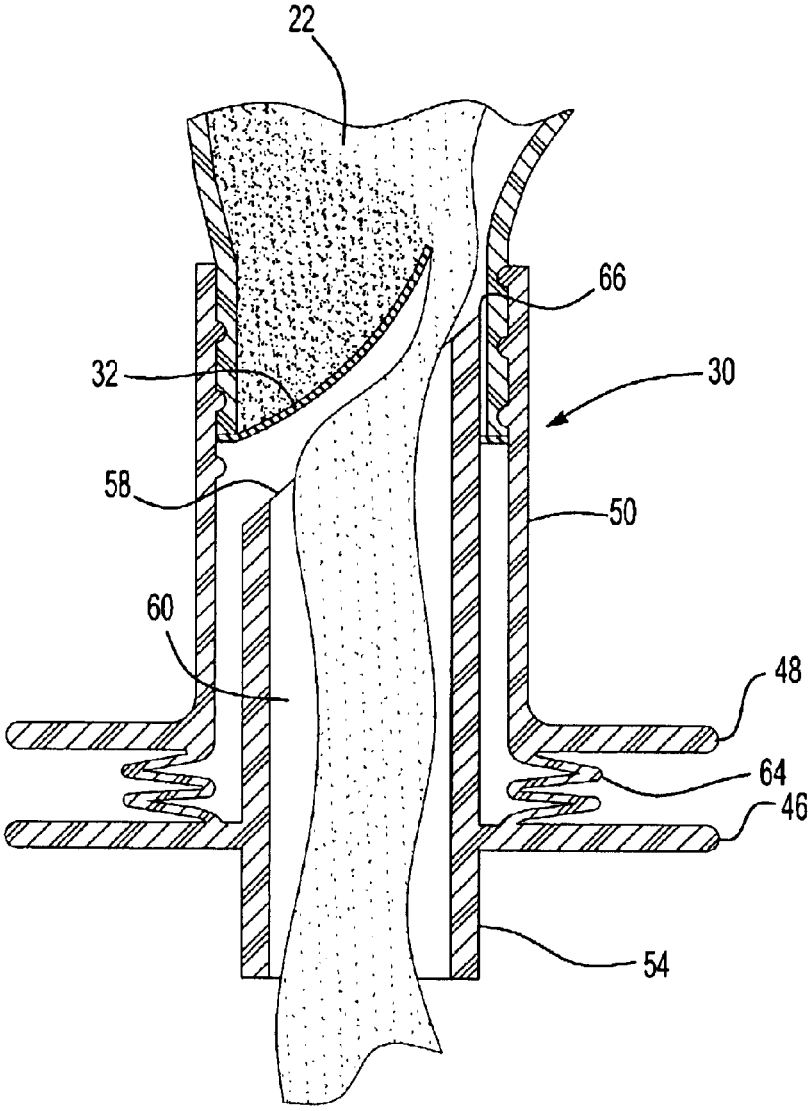
FIG. 7 is a sectional view cut along line 3—3 in FIG. 1 illustrating an alternate detachable embodiment of the flow controller for a container of the present invention in an inverted and open or in-use condition.

Slide member 54 has a hollow annular tubular form and is slidably and rotatably carried within slide member guide 50 forming a dispensing passage 60 for container 20 (FIGS. 4 & 7). Slide member 54 is open at its inner edge 58, but closed at its outer end 55 by a removable closure cap 62 during shipping and storage. Closure cap 62 may be threadably mounted to slide member 54 (as shown by external threads 38 and internal threads 80). The slide member 54 is mounted to remain within slide member guide 50 using means known in the art such as a tight frictional sealing engagement, a removable shipping seal (not shown), and the like.

FIGS. 5, 6, and 7 illustrate a means to mount the slide member 54 to the slide member guide 50 using accordion type bellows 64. Bellows 64 form a fluid tight seal by concentrically attaching to the peripheral flanges 46 and 48. The bellows 64 are sized to allow the shipping pin 40 to be attached and to hold the peripheral flanges 46 and 48 apart as described above.

The flow controller 30 can also be a separate unit adapted to be mounted on the container neck 24 of a conventional container 20 such as a plastic oil bottle and is illustrated in FIGS. 5, 6, and 7.

The preferred mount would be a threadable attachment. In this embodiment, neck 24 can have neck external threads 42 corresponding to a matching set of flow controller neck internal threads 44 on flow controller neck 45. This allows for the present invention flow controller 30 to be reusable and placed on prior art containers without modification.

In an alternate embodiment the detachable flow controller can be connected in a fluid tight snap fit manner to the container including an annular groove on one of the container or flow controller and a receiving lip on the other (not shown).

To illustrate how to open container 20 and dispense its contents using the present invention, a typical application of the present invention to dispense motor oil into a vehicle engine is provided. As described above, during storage or shipping, flow controller 30 is held in place by shipping pin 40 to prevent accidental breaking of seal 32. The user can remove shipping pin 40 and closure cap 62 and hold container 20 in an inverted position over an engine inlet for motor oil (not shown). At this point, the contents of the container are not released because seal 32 is still in tact.

To break seal 32, the user grasps the peripheral flanges 46 and 48 and squeezes them together to a position as indicated in FIGS. 4 and 7. This action urges the piercing point 66 against seal 32 causing it to puncture. Once punctured, gravity allows the oil to drain from container 20 into the engine.

Figure 8:
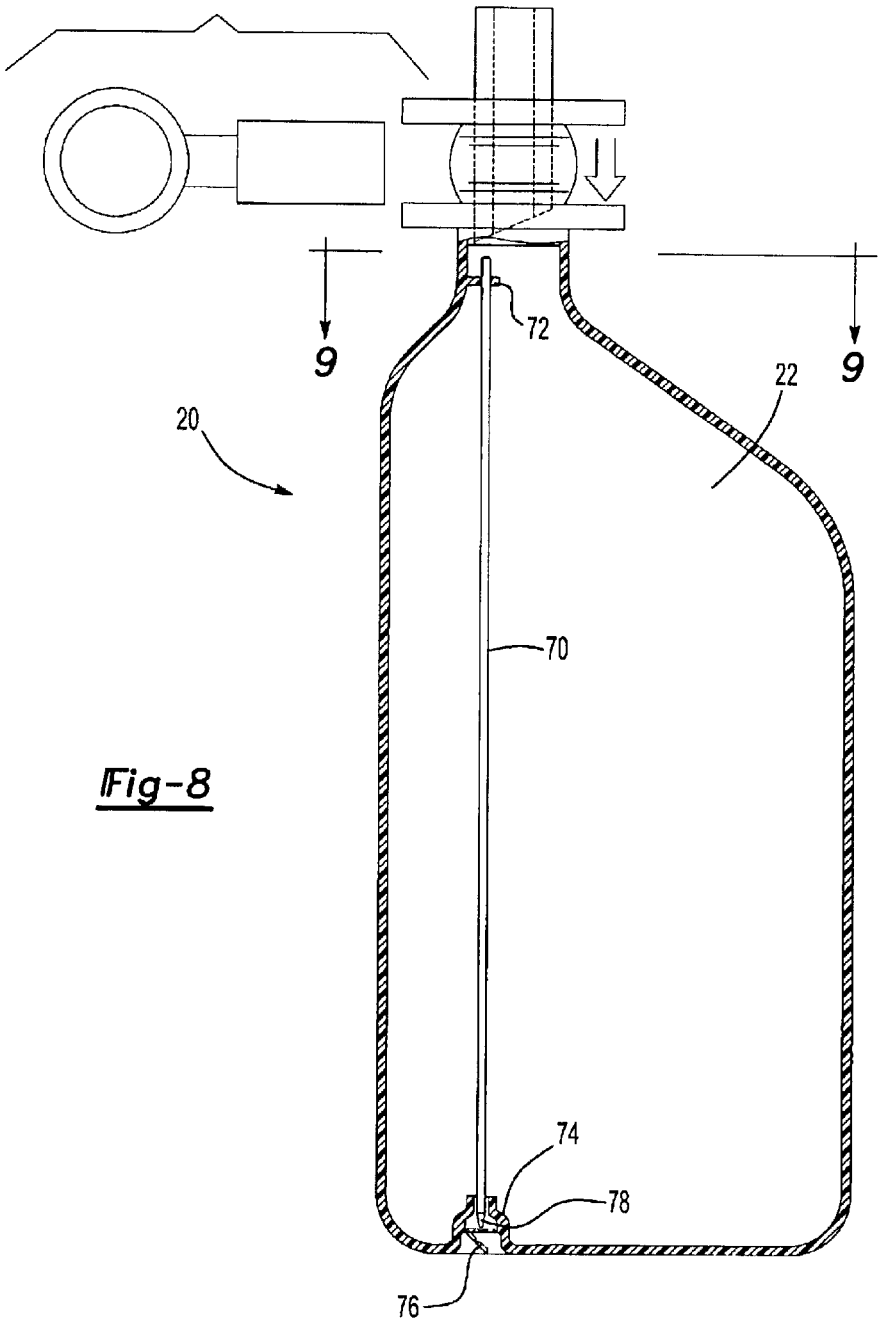
FIG. 8 is a side view of an alternate embodiment of the flow controller of the present invention attached to a container (container shown in cross-section) having a lancing pin within the container.
Figure 9:
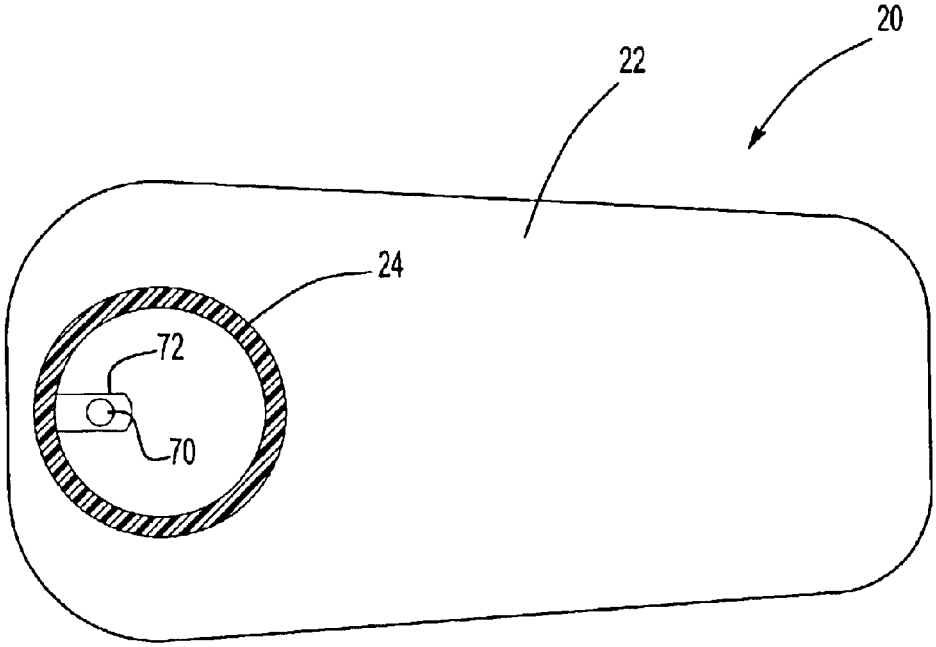
FIG. 9 is a sectional view cut along line 9—9 in FIG. 8.

FIGS. 8 and 9 illustrate an alternate embodiment of the present invention that includes means to vent air into the container while the contents are being released. In this illustration, container 20 is modified to include a lancing pin 70 disposed within container 20 and slidably supported by a top bracket 72 and a bottom bracket 74. Top end of lancing pin 70 is positioned to meet inner edge 58 of slide member 54 as it is pressed past seal 32 as the contents are draining. This motion presses a sharpened end 78 of lancing pin 70 through the bottom of container 20 via a puncturable air vent 76. The puncturable air vent 76 can be made of any type of puncturable material (such as thin walled plastic or rubber).

The term "container" in the initial description of the shape of the container may be used in a comprehensive sense, and is intended to encompass containers having round or circular walls, as well as those with planer panels and rectangular, cylindrical configurations.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention, as defined in the appended claims.

We claim:

1. A flow controller for use on a container having an opening with a puncturable seal, comprising:

a shipping pin;

a slide member guide including a neck configured to attach to a container, and a first peripheral flange on an outer surface of the slide member guide;

a slide member having an inner end and an outer end, the inner end having an open inner edge and is slidably received within the slide member guide, the outer end receiving a removable cap, the slide member having an outer surface and a second peripheral flange on the outer surface positioned to provide an annular space for insertion of the shipping pin between the first and second peripheral flanges and to prevent the inner edge of the slide member from contacting the container seal.

2. The flow controller of claim 1, wherein the neck is threadably attached to the container.

3. The flow controller of claim 1, wherein the neck is frictionally connected to the container.

4. The flow controller of claim 1, wherein the slide member is frictionally attached within the slide member guide.

5. The flow controller of claim 1, further including accordion bellows concentrically attached to the first and second peripheral flanges.

6. The flow controller of claim 5, wherein the accordion bellows form a fluid tight seal between the slide member guide and the slide member.

7. A device for controlling the flow of fluid from a container, comprising:

a shipping pin;

a container having an interior reservoir, a neck and a slide member guide, the neck including a seal, the slide member guide including a first peripheral flange on an outer surface of the slide member guide;

a slide member having an inner end and an outer end, the inner end having an open inner edge and slideably received within the slide member guide, the outer end receiving a removable cap, the slide member including a second peripheral flange on an outer surface of the slide member to provide an annular space for insertion of the shipping pin between the first and second peripheral flanges and to prevent the inner edge of the slide member from contacting the seal.

8. The device of claim 7, further comprising means to hold the slide member within the slide member guide.

9. The flow controller of claim 7, further comprising an air vent.

10. The device of claim 9, wherein the air vent includes a vent cap releasably connected to an opening on the container.

11. The device of claim 10 wherein the vent cap is threadably connected to the aperture.

12. The device of claim 7, wherein the slide member is frictionally attached within the slide member guide.

13. The device of claim 7, further including accordion bellows attached to the first and second peripheral flanges connecting the first peripheral flange to the second peripheral flange.

14. The device of claim 13, wherein the bellows form a fluid tight seal between the first and second peripheral flanges.

15. The device of claim 7, wherein the seal is flexible.

16. The device of claim 7, wherein the seal is made of paper material.

17. The device of claim 7, wherein the seal is made of rubber material.

18. The device of claim 7 wherein the seal is made of plastic material.

19. The device of claim 7, further comprising:

a puncturable air vent attached to the container;

a top bracket connected to the neck within the interior reservoir of the container;

a bottom bracket connected to a lower portion of the interior reservoir; and a lancing pin disposed within the interior reservoir and slidably supported by the top bracket at a top end of the lancing pin and by the bottom bracket at a bottom end of the lancing pin, the top end of the lancing pin positioned to contact the inner edge of the slide member as the slide member is urged past the container seal, and the bottom end of the lancing pin having a sharpened end positioned to allow puncturing of the air vent upon urging of the lancing pin by the slide member inner edge.

* * * * *